US007242317B2

(12) United States Patent
Silvers

(10) Patent No.: US 7,242,317 B2
(45) Date of Patent: Jul. 10, 2007

(54) WIRELESS WELL COMMUNICATION SYSTEM AND METHOD

(75) Inventor: David Silvers, Mancelona, MI (US)

(73) Assignee: SilverSmith, Inc., Gaylord, MI (US)

( * ) Notice: Subject to any disclaimer, the term of this patent is extended or adjusted under 35 U.S.C. 154(b) by 400 days.

(21) Appl. No.: 10/709,648

(22) Filed: May 19, 2004

(65) Prior Publication Data

US 2004/0231851 A1 Nov. 25, 2004

Related U.S. Application Data

(60) Provisional application No. 60/320,206, filed on May 20, 2003.

(51) Int. Cl.
*G01V 3/00* (2006.01)

(52) U.S. Cl. ..... 340/853.3; 340/853.1; 166/369; 709/224

(58) Field of Classification Search ..... 340/853.3, 340/853.1; 73/152.18; 709/224; 166/250.01, 166/369

See application file for complete search history.

(56) References Cited

U.S. PATENT DOCUMENTS

| | | | | |
|---|---|---|---|---|
| 3,629,859 | A | 12/1971 | Copland et al. | |
| 3,760,362 | A | 9/1973 | Copland et al. | |
| 5,160,925 | A | 11/1992 | Dailey et al. | |
| 5,339,905 | A | 8/1994 | Dowker | |
| 5,662,165 | A | 9/1997 | Tubel et al. | |
| 5,706,896 | A | 1/1998 | Tubel et al. | |
| 5,818,352 | A | 10/1998 | McClure | |
| 5,864,772 | A | 1/1999 | Alvarado et al. | |
| 5,983,164 | A | 11/1999 | Ocondi | |
| 6,192,988 | B1 | 2/2001 | Tubel | |
| 6,266,619 | B1 | 7/2001 | Thomas et al. | |
| 6,364,021 | B1 | 4/2002 | Coats | |
| 6,392,561 | B1 | 5/2002 | Davies et al. | |
| 6,446,014 | B1 | 9/2002 | Ocondi | |
| 6,462,672 | B1 | 10/2002 | Besson | |
| 6,851,444 | B1 * | 2/2005 | Kohl et al. | 137/13 |
| 2002/0195247 | A1 | 12/2002 | Reinhart | |
| 2003/0192692 | A1 | 10/2003 | Paulo | |
| 2004/0010587 | A1 * | 1/2004 | Altamirano et al. | 709/224 |
| 2004/0028023 | A1 * | 2/2004 | Mandhyan et al. | 370/351 |
| 2004/0051650 | A1 * | 3/2004 | Gonsoulin et al. | 340/853.1 |

FOREIGN PATENT DOCUMENTS

| | | |
|---|---|---|
| WO | WO 2001/23705 | 4/2001 |

* cited by examiner

*Primary Examiner*—Timothy Edwards, Jr.
(74) *Attorney, Agent, or Firm*—McGarry Bair PC

(57) ABSTRACT

Well data and production control commands are transmitted from a remote central data store to wells at a remote location with a well hopping system and method, preferably through a radio frequency (RF) network. Request packets are sent through a field station to one or more well units until it reaches the destination well unit. The destination well unit executes the data request or the command and sends a response data packet back to the central data store through the RF network using the same well hopping system and through the field station. The central data store reads and stores the data. One or more satellite offices are connected to the central data store and can download data from the central data store or send/receive data packets to/from the well units. Oxygen content in production gas can be detected and transmitted to the central store for monitoring and reporting.

24 Claims, 7 Drawing Sheets

WIRELESS WELL COMMUNICATION SYSTEM AND METHOD

CROSS-REFERENCE TO RELATED APPLICATION

This application claims the benefit of U.S. Provisional Application No. 60/320,206, filed May 20, 2003.

FIELD OF THE INVENTION

This invention relates to well communication systems. In one of its aspects, the invention relates to a wireless well communication, monitoring, and control system. In another of its aspects, the invention relates to a wireless radio frequency communication system for transferring commands and data between wellheads and a central data store. In yet another of its aspects, the invention relates to a method for wireless well communication. In still another of its aspects, the invention relates to a method for transferring commands and data between wellheads and a central data store using a wireless radio frequency system. In still another of its aspects, the invention relates to the remote monitoring of oxygen content of production gas that is delivered to a pipeline on a real time basis.

DESCRIPTION OF THE RELATED ART

Natural gas and oil production wells are commonly located in fields that are remote from the operating company's office or headquarters. It is extremely expensive and time consuming for on-site technicians to monitor and control each individual well. As a result, several systems for communicating with wells from remote locations have been developed. Typically, gas wells will have monitoring equipment at the ground surface for collecting production data of the well. The monitoring equipment sometimes has controls for operating a water pump off system. See, for example, U.S. Pat. No. 5,634,522, which is incorporated herein by reference in its entirety. In other cases, a timer is used to control the injection of pressurized gas into the production tube through a side string tube to control the pump off of water. See for example, U.S. Pat. No. 5,339,905.

Many of the communication systems have a surface control component that communicates directly with the remote location and some further comprise downhole control components that communicate with the surface control component. For example, in U.S. Pat. No. 6,192,988 to Tubel, a production well telemetry system for monitoring and automatically controlling downhole tools is described wherein main borehole control devices each individually communicate with surface control components via wireless or wireline. Transceivers in the borehole laterals communicate with the main borehole control devices through short hop communications involving electromagnetic or acoustic transmissions. The surface control component interfaces with a remote central control system via satellite and surface control components at other wellheads through phone lines, satellite communication or other means.

Another example is in U.S. Pat. No. 5,864,772 to Alvarado et al., which describes a system that transmits and displays acquired well data from a downhole logging tool. The logging tool is connected to a primary (first) location, which can be the well site, through a wire line, and the primary location communicates with a remote location via one of several types of communication systems. The data can be viewed at the primary and remote sites in near real time.

U.S. Pat. Nos. 6,446,014 and 5,983,164 to Ocondi disclose an apparatus and method for measuring and controlling flow of fluids from coal seam gas wells. Data collected from transducers is stored in a component system at the well, compressed, and transmitted to the central operations office via wireless or conventional phone systems or via satellite, and the wells can also communicate with each other. Further, control strategies can be downloaded from the central operations office to the well component system.

A system for managing and servicing offshore oil fields is described in U.S. Pat. No. 6,364,021 to Coats. Each wellhead in the field is equipped with a buoy that receives data from sensors in the riser and wellbore. The buoy wirelessly transmits the data to a service vessel, which can, in turn, communicate with a remote station through a telecommunication system.

U.S. Pat. Nos. 3,629,859 and 3,760,362 to Copland et al. describe a telephone line-based apparatus and method for remote computer evaluation and control of oil fields. A master station communicates through commercial telephone exchanges with a remote terminal unit at a satellite station, which is an oil well site. Several well test units can be associated with a remote terminal unit, and several wells can be associated with one well test unit. Ultimately, data and commands are sent back and forth between the wells and the master station.

It has been found that small amounts of oxygen are present in natural gas that has been produced from the ground and process for delivery to a pipeline. When the oxygen is not removed from the gas, it can cause significant corrosive damage to the pipe line. As a result, well operators are required to maintain oxygen content below a predetermined maximum, for example, 3 parts per million (ppm) and must certify to the pipeline operator that the gas delivered to the pipeline is below that limit. Oxygen monitors are used to detect the oxygen content in natural gas and record the level of oxygen in the content of natural gas over the period of each day. The monitors are at the delivery point and typically must be read by a third party certifier on a daily basis in order to generate certified reports.

SUMMARY OF THE INVENTION

According to the invention, a system for communicating between wells and a remote location comprises a central data store, a field station, at least one well unit, and optionally, one or more satellite offices. The central data store is connected to the internet and has a web server that is used to view collected data. The data processor is programmed to transmit data through the internet or other suitable communication media to a field station. The field station has an internet connection, such as a satellite dish or a broad band connection, to receive data from the central data store and a converter for converting the received data, for example, into serial RS 232 format, and a transmitter to transmit the converted data to a well hopping communication system formed of two or more well units. The at least one well unit is adapted to be located at the well sites and include an integrated communications and control unit. The well units have data collecting modules for collecting well data, such as production flow rates on a continuous basis, and quantities of gas produced periodically, for example, on a daily, weekly and monthly basis. Other well data such a temperature for each as a function of day and water level in the well can be gathered at the well head and collected by the well units. The integrated communications and control module further include a radio module for sending to and receiving data from other well units and the field station. The integrated communications and control module further has computer processing unit that runs solely on transistor-transistor logic (TTL) level voltages.

The satellite offices have computer terminals and connections to the internet or otherwise to the central store to communicate with the central store computers to request and receive data from the central store. The central data store, the optional one or more satellite offices, and the field station preferably communicate through the Internet, and the field station and the at least one well unit communicate through a well hopping communication system via radio waves. The radio waves preferably utilize a 900 MHz frequency band, and the at least one well unit can be located at the surface of a well.

Further according to the invention, a method for gathering operating data from a plurality of geographically spaced oil or gas producing wells comprising the steps of gathering well production data relating to at least one of the spaced oil or gas producing wells; transmitting the gathered well production data to a central data storage zone and storing at least some of the transmitted data in the central storage zone. According to the invention, the transmitting step includes a well hopping step that includes transmitting data from the at least one well along a well hopping path that includes the at least one well and at least one other of said wells.

In a preferred embodiment of the invention, the transmitting step further includes transmitting the data between the well hopping path and the central data storage zone through the internet. Typically, the transmitted data is correlated according to wells at the central data storage. It is thus retrievable and displayed. The collected well data includes a variety of information including gas or oil production, water production, gas flow rates, the level of water in the well, the pressure of the gas in the well bore, the differential pressure of the gas production tube, temperature of the gas and timing cycles of water removal or level of water in the well.

Preferably, selected portions of the stored data in the central data storage zone is accessed from a site remote from the central data storage zone, for example, by customers who operate one or more wells. At least on well can be polled by a customer from a remote site or by the central data store prior to the gathering step and the gathering step is responsive to the polling step. Typically, the central data storage zone will poll all of the wells periodically and the gathering step includes gathering well production data from each of the poled wells. The data collected as a function of time is stored in the central data storage zone. The gathering step is responsive to the polling step. The polling step includes transmission of data requests to each of the wells along the data transmission path but in the opposite direction.

The method of the invention is carried out on wells that are geographically spaced in the field. The spacing of wells can vary over a wide range but typically will be in the range of ½ to 1 mile. In a preferred embodiment of the invention, 900 MHZ frequency bandwidth radio waves are used for transmission of the data along the hopping paths to an internet provider station. For this type of radio waves, the wells are typically spaced less than 1 mile apart. Thus, in a preferred embodiment of the invention, the well hoping step includes wireless transmission of the gathered data between the geographically spaced wells.

In the practice of the invention, each of the wells is assigned a unique address and at least one well hoping path between each well and the central data store zone. Typically, each well is assigned a preferred well hopping path and one or more alternative well hopping paths in the event that one of the transmitters in the main path is not functioning. According to the invention, any of the hopping paths can be easily changed at the central data store or storage zone.

Further according to the invention, the level of oxygen in a production stream from one or more of the wells can be detected and transmitted to the central data storage zone through the well hopping path. Typically, the oxygen level is measured at the point where the gas is fed into a commercial pipe line. That point is usually at a processing plant which is in close proximity to one or more wells in a well hopping path. The oxygen level data is gathered on a periodic basis, for example, every ten minutes, and transmitted through the unique well hopping transmission process to the central data storage zone where it is stored and displayed. The information can be processed for certifying that the gas that enters the pipeline has an oxygen content below a predetermined maximum.

The invention further relates to a method for communicating between wells and a remote location comprising the steps of sending from a central data store to a field station via the Internet a request data packet intended for a destination well unit, transferring the request data packet from the field station to a first well unit via radio waves, determining if the first well unit is the destination well unit, if the first well unit is not the destination well unit, hopping the request data packet along a series of at least two well units, wherein the first well unit is part of the series, until the request data packet reaches the destination well unit.

The method can also include the steps of sending a response packet from the destination well unit to field station, hopping the response packet from the destination unit along the series of at least two well units if the first well unit is not the destination well unit until the destination packet reaches the field station, and sending the response packet from the field station to the central data store via the Internet.

The current invention provides a cost-effective well communication system and method having several advantages. The "well hopping" serial arrangement is inherently efficient and permits facile communication between wellheads clustered together or distant from each other within a well field. The main forms of communication within the system are the Internet and radio waves, which are well known, robust, easily accessible, and cost effective. Additionally, the system itself has several quality control functions to ensure that communication, which includes commands for controlling in addition to monitoring well production, between the wellheads and the remote location is effectual and accurate.

BRIEF DESCRIPTION OF THE DRAWINGS

The invention will now be described with reference to the accompanying drawings in which.

DESCRIPTION OF THE PREFERRED EMBODIMENTS

Figure 1:
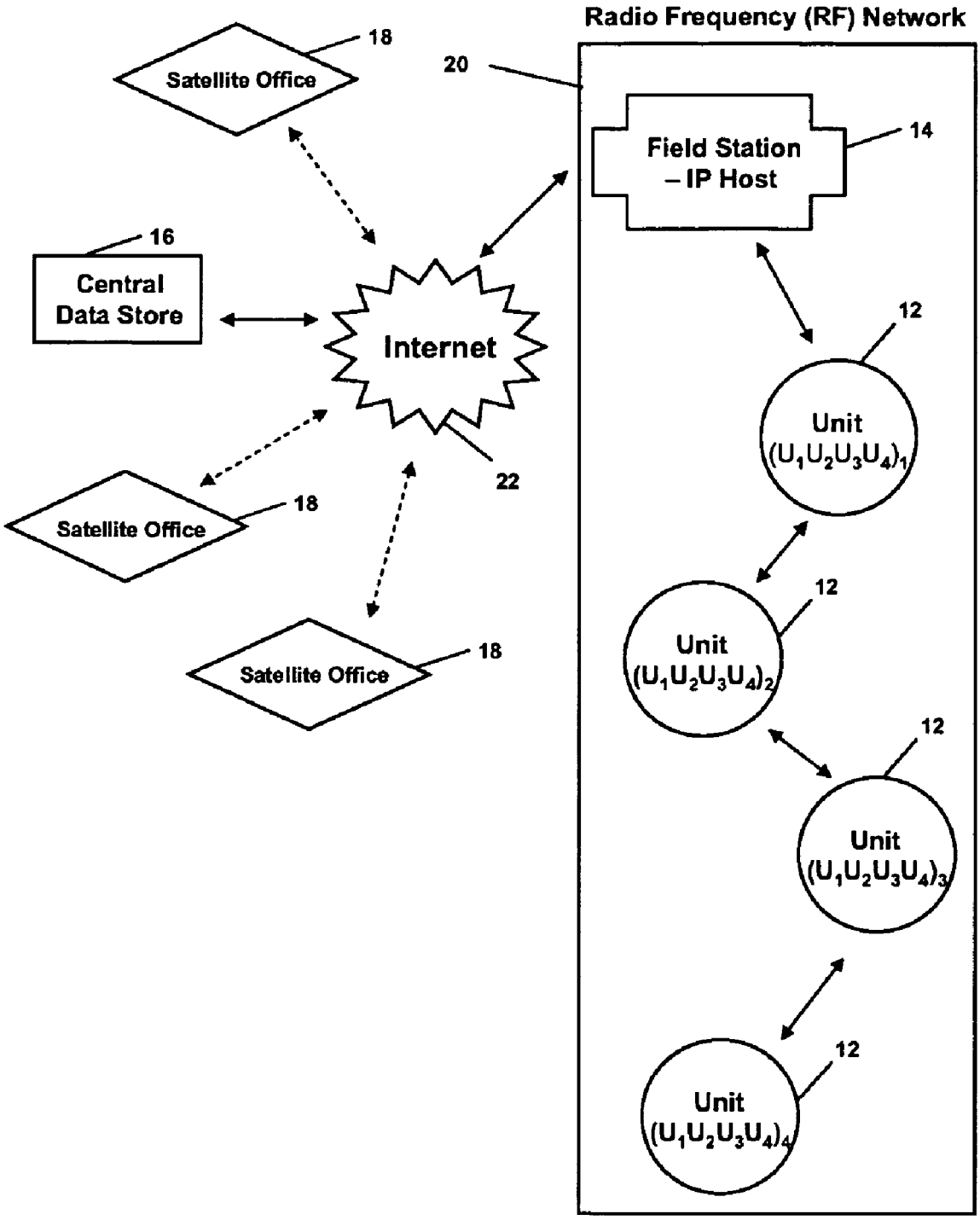
FIG. 1 is a schematic view of a wireless well communication system according to the invention.

The invention relates to a system for communicating between wells and remote locations. Referring to the drawings, FIG. 1 depicts a well communication system 10 comprising multiple well units 12, at least one field station or Internet Protocol (IP) host 14, a central data store 16, and, optionally, satellite offices 18. The well units 12 are located at the surface of individual gas, oil, or other type of wellheads in a field, and each well unit 12 has a unique unit identification (ID) number, for example, a four digit number $U_1U_2U_3U_4$. The well units 12 have monitors that collect production data, such as flow volume, flow rate, temperature, and pressure, and have transceivers that transmit and receive commands to control well production, for example, to open or close valves for production or for water pump off. Examples of systems that collect well production data and gas well production apparatus are disclosed in U.S. Pat. Nos. 5,983,164 and 6,446,014, both of which are incorporated herein by reference in their entirety.

Within the field, the wellheads can be in close proximity of each other or they can be several miles apart. Groups of well units 12 in a field are generally associated with one field station 14, but multiple field stations 14 can be employed depending on the size of the field. Together, the well units 12 and their corresponding field station 14 comprise a wireless radio frequency (RF) network 20 and communicate using a 900 MHz, a 2.4 MHz, an Industrial, Scientific, or Medical (ISM), any no-license, or any other suitable frequency band. Radio wave communication is well known and need not be described further. The field stations-IP hosts 14 have conventional radio transceivers for receiving radio signals from the field and sending radio signals to the well units 12 in the field. In addition, the field stations-IP hosts 14 have serial-to-IP converters for converting the internet signals to RS 232 radio signals and visa versa. The field stations IP hosts 14 further have an internet connection, for example, satellite, cable modem or the like. The IP hosts 14 collect RS 232 radio signals from the well units 12, convert them to internet signals and transmit them to the central data store 16 via the internet 22. Examples of serial to IP converters that are used in the field stations-IP hosts 14 are IPHost equipment Lantronix UDS-10 available from Lantronix of Irvine, Calif., a standard Internet Connection (such as satellite, cable, DSL, etc.), a transceiver (such as a 900 mhz Radio and 900 mhz Antenna), various interconnecting cables (such as LMR200 and LMR400 cable and connectors), a housing (such as a 24×20×8 steel enclosure capable of withstanding severe environmental conditions), and a serial to IP converter, the use of which would be apparent to one skilled in the art.

The central data store 16 has a server and computer processor to store the data received from the field station-IP host 14. Examples of servers and computer processors that are used at the central data store 16 include, by illustration only and not by way of limitation: an Internet connection (satellite, cable, DSL, etc.), a suitable server computer, a web server, preferably containing a suitable database access connector (such as ODBC, SQL, mySQL, Oracle and the like), a website code such as SilverSmith Web code and automatic polling software such as SilverSmith TRaineAuto Service.

Figure 2A:
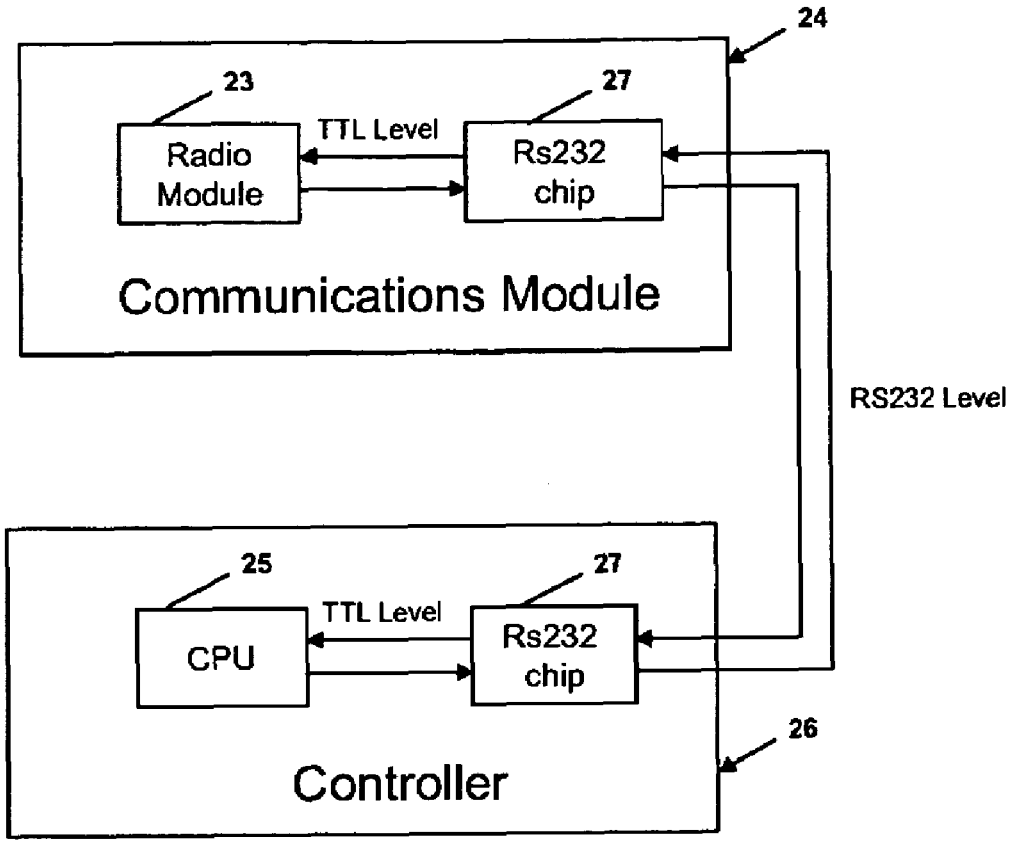
FIGS. 2A-2C are schematic views of radio communication hardware for use in the wireless well communication system shown in FIG. 1.

Each well unit 12 is equipped with a communications module 24 for radio communication and a controller 26 for data logging and storage. The communications module 24 comprises a communications device, such as a radio module 23 (transceiver), and the controller 26 comprises a central processing unit (CPU) 25 including at least one circuit board. As shown schematically in FIG. 2A, each of the communications module 24 and the controller 26 comprises industry standard RS232 chips 27 to facilitate communication therebetween. This system, which has a current consumption of about 110 mA, applies RS232 level voltages between the RS232 chips, and the RS232 levels are converted into transistor-transistor logic (TTL) level voltages for the radio module 23 and the CPU 25.

Figure 2B:
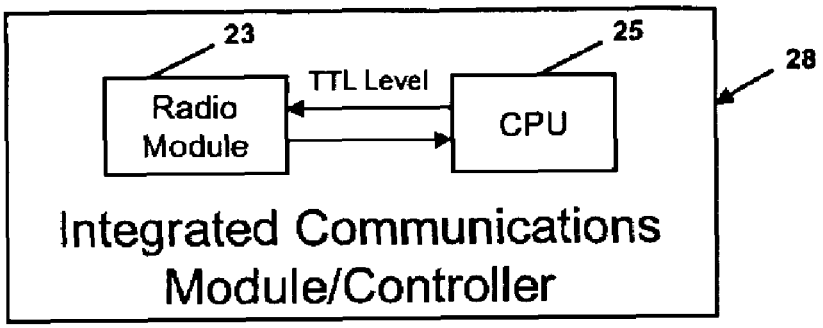

A preferred system is schematically illustrated in FIG. 2B, wherein the communications module 24 and the controller 26 are combined into an integrated communications and controller unit 28. The integrated unit 28 comprises the radio module 23 and the CPU 25, which both use TTL level voltages, and does not require the two RS232 interface chips 27. Because the integrated unit 28 can run solely on TTL level voltages without converting to RS232 level voltages, the current consumption is reduced to about 45 mA. As a result of the reduced low power consumption, requirements for battery size and solar panels are significantly reduced. Consequently, the overall cost of the integrated unit 28, including hardware and the operational expenses, is less than the system shown in FIG. 2A. A commercial example of the integrated communications and controller unit 28 is the HTC1000 controller circuit board, which is produced by SilverSmith, Inc. of Gaylord Mich.

Figure 2C:
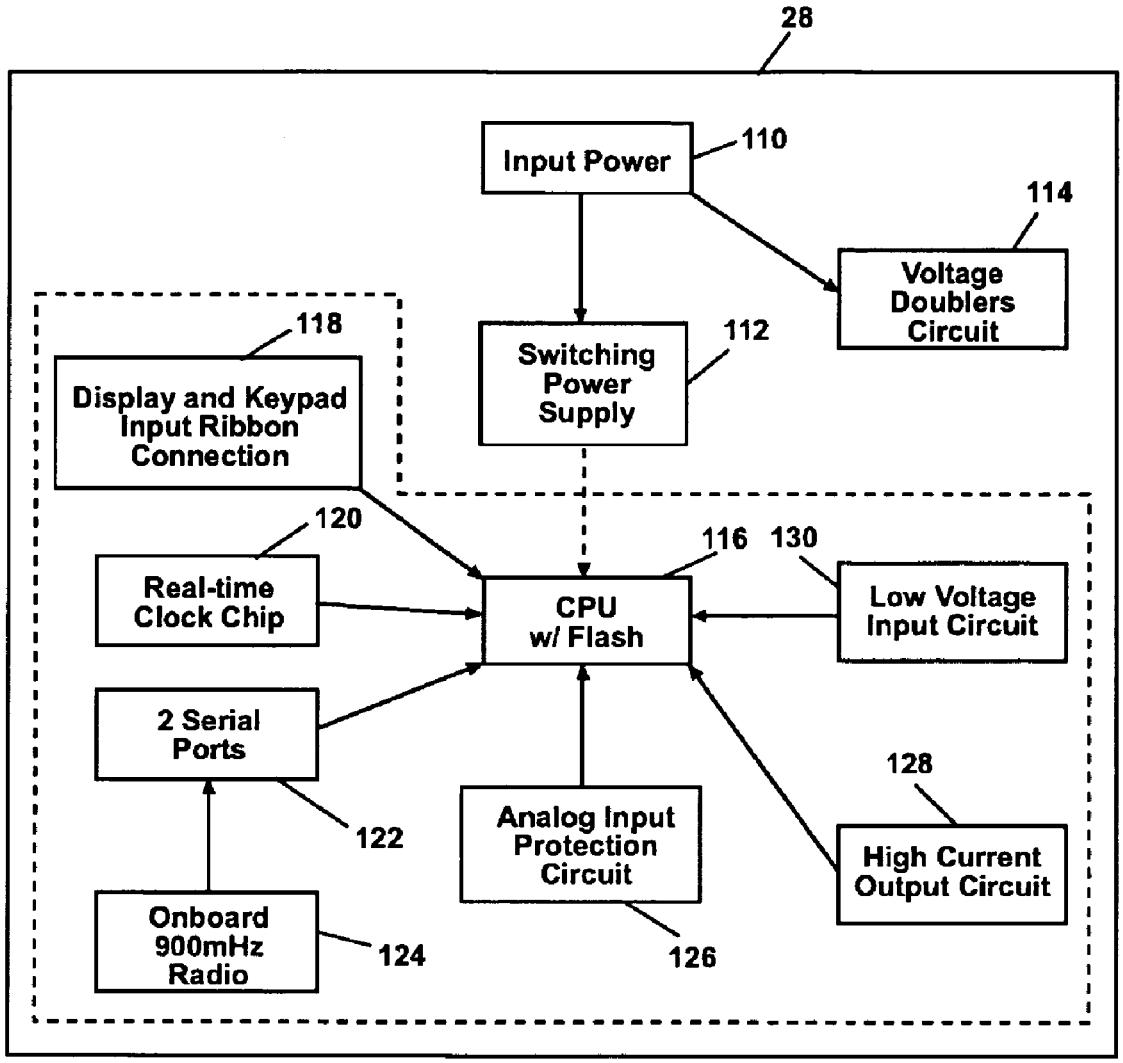

FIG. 2C shows additional exemplary hardware used in an integrated unit 28 made up of the communications module 24 and the controller 26. The example integrated field unit 28 of FIG. 2C includes a main circuit board having a suitable processor 116 supplied with power from an input power source 110. The input power source 110 is connected to a switching power supply 112 which is a well-known unit for controlling the supply of power to components of the circuit board on an "as needed" basis so that power is not needlessly depleted from the input power 110. The input power source 110 is also connected to a voltage doubler circuit 114 which has the function of double input voltage for sensors that require higher input voltage.

A conventional input keypad and output display 118 is connected to the processor 116 by a conventional connection, such as a ribbon cable. The display component can be a standard 128×64 LCD display typically found on controllers or any other suitable display for communicating visual information to a user of the system. A real time clock chip 120 can be provided operably connected to the processor 116. The real time clock chip 120 performs the function of keeping the real time for the cpu. One or more serial ports 122 are provided operably interconnected to the processor 116 for interconnection of external components to the processor 116, such as an onboard radio unit 124. An analog input protection circuit 126 is operably interconnected with the processor 116 that performs the function of protects the analog to digital converter from voltage spikes. A high current output circuit 128 is operably interconnected with the processor 116 that performs the function of providing a high-current source of power to provide sufficient power for opening and closing gas lift valves on the field unit. A low voltage input circuit 130 is operably interconnected with the processor 116 that performs the function of filtering input from sensors which are operably interconnected on the field unit to the processor 116 in a manner which would be apparent to one skilled in the art.

A SIDPG Sensor Board is operably connected to the main circuit board for the purpose of gas measurement. Examples of suitable sensors can include a Motorola mp×5700 gauge cell for gas measurement and a Motorola mp×5050 dp cell for gas measurement.

A suitable antenna, such as a 900 mhz antenna (or an antenna suitable for whatever frequency or protocol has been selected for the system) can be mounted on the field unit to improve signal transmission and reception at the field unit. A vertically-extending mast can be provided which heightens the antenna to additionally improve transmission and reception. A suitable power source can be provided such as a standard or rechargeable battery—such as a standard 12 v battery. A solar panel (such as a standard 10 W variety) and charge controller can be installed on the field unit to recharge the battery.

Wire, conduit, and connectors (including but not limited to LMR200 and LMR400 cable and connectors) are selected from a wide array of commercially available suitable components and would be apparent to one skilled in the art to interconnect the various components of FIG. 2C.

The central data store 16 is at a remote location relative to the well units 12 and communicates with the field stations 14 via the Internet 22 or other appropriate communication system. For example, a company may operate several wells in different and distant fields, and the central data store 16, which communicates with the respective field stations 14, can be located at the company's headquarters. In addition to the central data store 16, the optional satellite offices 18, which can be of any number and at any location, can communicate with the field stations 14 via the Internet 22. Further, the central data store 16 and the field stations 14 can communicate with each other via the Internet 22.

The well communication system 10, the detailed protocol for which will be described hereinafter, transmits commands and inquiries from the central data store 16, through the Internet 22, to the appropriate field station 14, through the RF network 20, and to the destination well unit 12. Once the destination well unit 12 receives the commands, the well unit 12 transmits a response back through the RF network 20, to the field station 14, through the Internet 22, and to the central data store 16. Furthermore, the satellite office 18 can download data from the central data store 16 and can likewise submit a command to and receive a response from the destination well unit 12. For brevity, the remainder of the document will refer to the central data store 16 as the remote location when describing communication between the remote location and the well units 12; however, it is to be understood that the satellite office 18 can be substituted for and function as the central data store 16.

Within the RF network 20, the well units 12 communicate by "well hopping," wherein the well units 12 transmit information in a series rather than each individual well unit 12 communicating directly with the field station 14. For example, in FIG. 1, if the central data store 16 sends a command to well unit $(U_1U_2U_3U_4)_4$, the information is sent to the field station, then to well unit $(U_1U_2U_3U_4)_1$, next to well unit $(U_1U_2U_3U_4)_2$, next to well unit $(U_1U_2U_3U_4)_3$, and ultimately to well unit $(U_1U_2U_3U_4)_4$. Transmission of information back to the central data store 16 is accomplished in the same manner but in the reverse direction. The "well hopping" system permits efficient and expedient communication between well units 12 and transmission of information to and from wells.

Figure 3A:
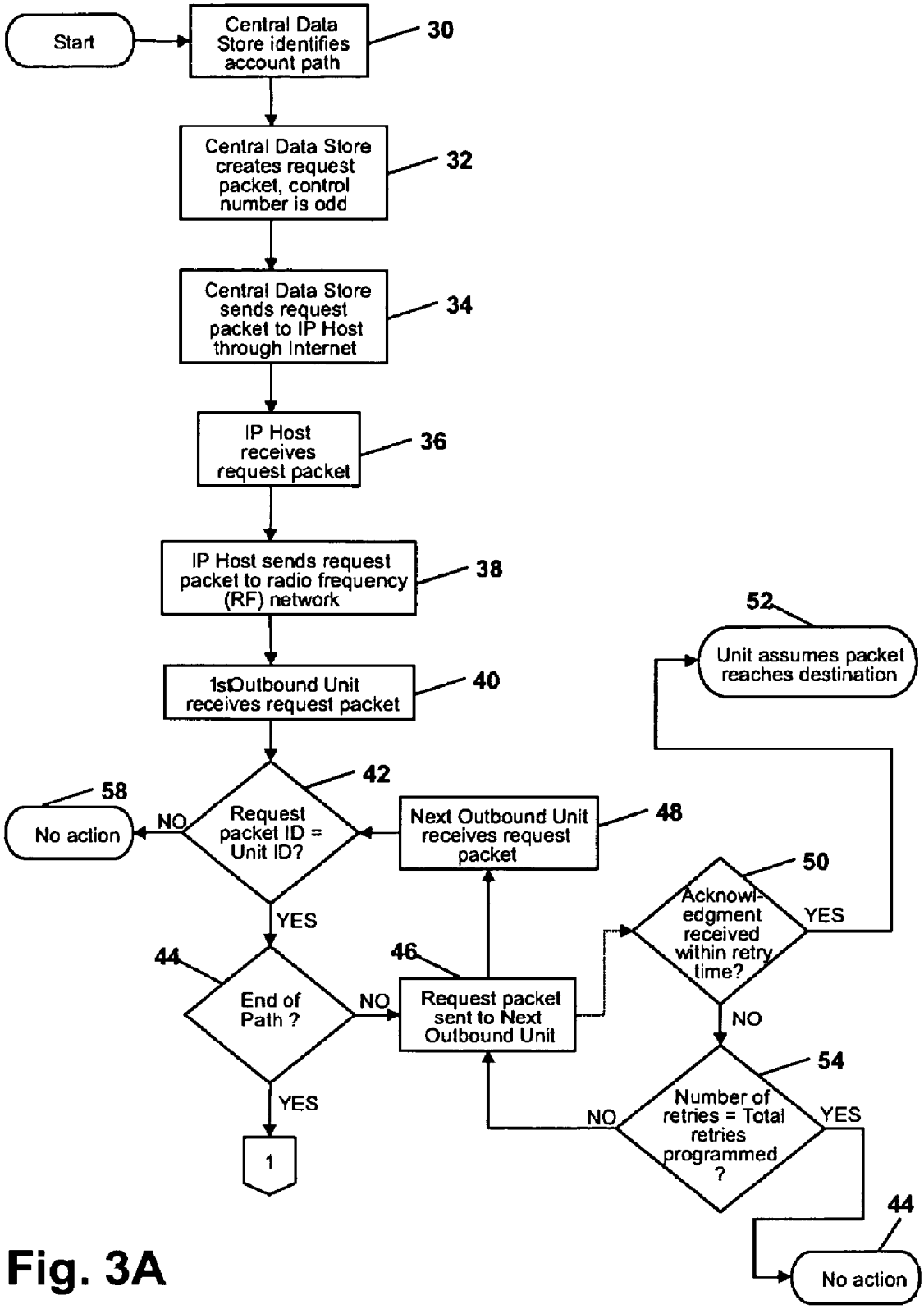
FIGS. 3A and 3B are a flowchart depicting communication between a central data store and a destination unit of the wireless well communication system in FIG. 1.
Figure 3B:
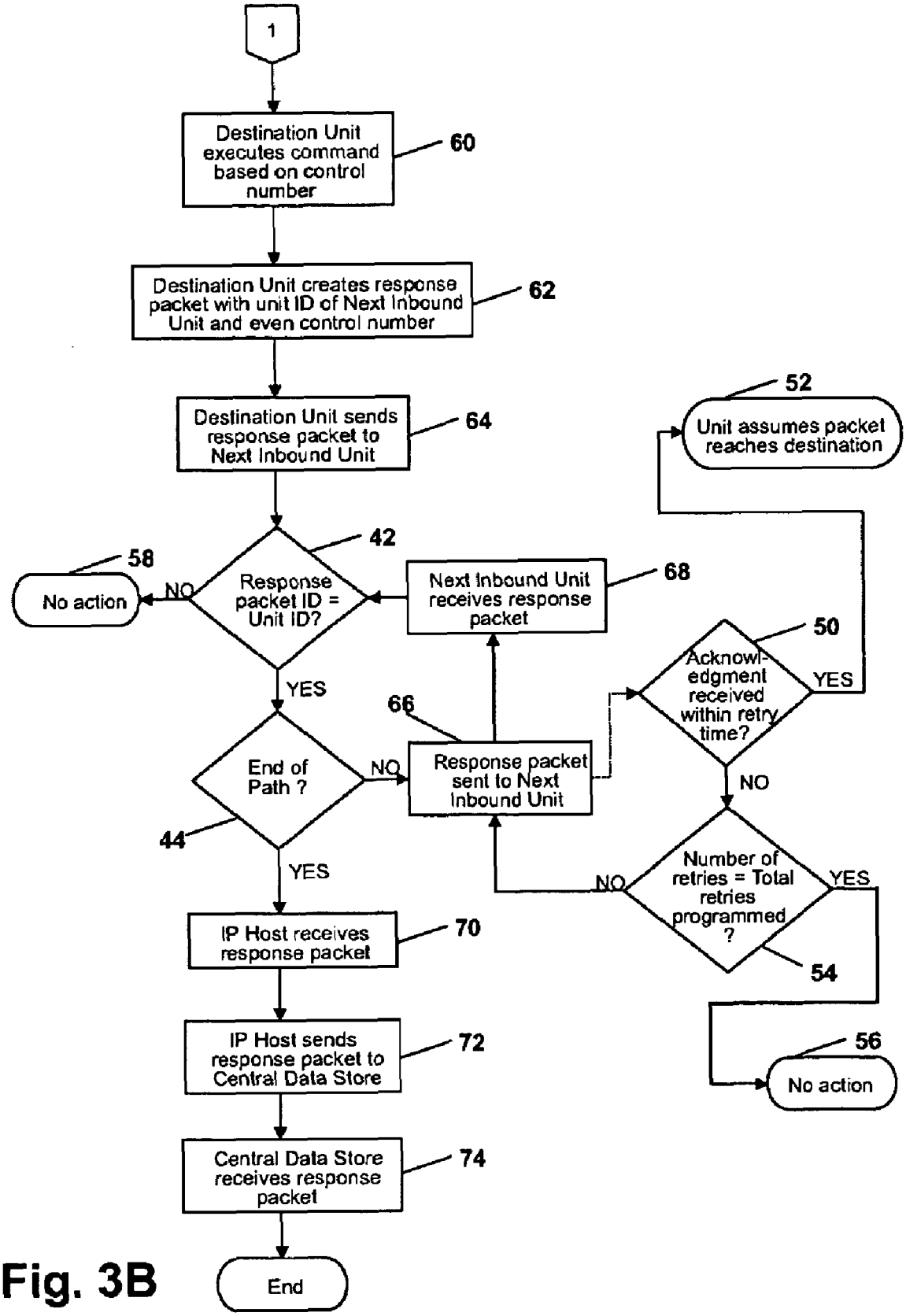

The protocol for transmission of information packets in the well communication system 10 will now be described with reference to the flow chart of FIGS. 3A and 3B. The central data store 16 houses route path data for all of the well units 12. The route path data contain unique identifiers or IP addresses of the IP hosts or field stations 14 and details about the paths the information packets must follow within the RF network 20 in order to reach the desired well units 12; therefore, each well unit 12 has one or more route paths. Once the appropriate route path is determined <30>, the central data store 16 creates <32> a request packet that contains information such as the command to be executed by the destination well unit 12, the unit identification number, and the route path. Next, the central data store 16 sends <34> the request packet to the IP host 14 through the Internet 22. Before the request packet reaches the IP host 14, the packet is converted from serial format to IP format by a converter device, such as an HTC Repeator or a Lantronics st-10 device. Typically, each well unit 12 has a preferred route path and one or more alternate route paths. In the event of failure of any of the well units 12 along a preferred path, the data can follow an alternate route path. After 5 failed attempts on a path, it will try the next path based on its preference.

An example of a format for the request packet is SS CC UUUU CCCC TT MM RRR . . . DDD . . . XXXX, wherein the each portion of the request packet is as follows:

| REQUEST PACKET | DESCRIPTION |
|---|---|
| SS | two digit start bit |
| CC | two digit control number |
| UUUU | four digit unit identification number of the next path unit |
| CCCC | four digit company number |
| TT | two digit count of total hops required to reach the destination unit |
| MM | two digit count of hops made |
| RRR... | route path to reach the destination unit |
| DDD... | data to send or receive |
| XXXX | four digit cycle redundancy check (CRC) |

The request packet control number ends in an odd digit, which instructs the well units 12 that the packet is outbound. Examples of control numbers for request packets sent from the central data store 16 are:

| CONTROL | COMMAND |
|---|---|
| 01 | Ping test (checks the communication link) |
| 03 | Snap shot (request current flow rate and alarm status) |
| 05 | Daily average (request the average flow rate since the gage is off) |
| 07 | Pre-day history (retrieve the last 24 hour totals) |
| 09 | Selected history day (retrieve totals from selected day) |
| 11 | Valve on (turn valve on) |
| 13 | Valve off (turn valve off) |

The DDD . . . portion of the request packet can contain data that particularize the control number commands, for example the selected day for control number 09 and valve identification for control numbers 11 and 13. Finally, the four digit CRC at the end of the request packet is the sum of the bytes in the packet and is used to verify that the entire packet has been transmitted. If the bytes received by the well unit 12 does not sum to the CRC number, then the well unit 12 knows that the packet is incomplete. The CRC check system is a successful and proven quality control tool. The request packet can be of any format suitable for transmission from the central data store 16, to the field station 14, and through the RF network 20 and is not limited to the format described herein. It is only required that the request packet contain desired commands and the information necessary to reach the destination well unit 12.

After the IP host 14 receives <36> the request packet, the packet is sent <38> through the RF network 20. The first outbound well unit, which is the well unit 12 in closest proximity to the field station 14, receives <40> the request packet and compares <42> the unit ID in the request packet to its own programmed unit ID. If the unit IDs do not match, no action is taken <58>. If the unit IDs are the same, then the well unit determines <44> whether the end of the predetermined path has been reached, such as by determining whether the number of hops made (MM) equals the total hops required to reach the destination unit (TT) (other examples of "end of path" determinations are described below with respect to FIG. 5). If MM and TT are not equal, the current well unit changes the unit ID in the request pack to that of the next outbound well unit, increases the number of hops made, and transmits <46> the request packet to the next outbound well unit, which, upon receipt <48> of the request packet, follows the same procedures of comparing <42> unit IDs and comparing <44> the number of hops made to the total number of hops required. These procedures are repeated until the request packet reaches the destination well unit.

After receipt of the request packet, the destination well unit executes <60> the command associated with the control number and subsequently creates <62> a response packet having the unit ID of the next inbound well unit and the route path required to relay the response packet to the central data store 16. The response packet format can be similar to that of the request packet; however, the control number must end in an even digit to instruct the well units 12 that the packet is inbound. Examples of control numbers for response packets from the destination well unit are:

| CONTROL | COMMAND |
|---|---|
| 02 | Ping test (return any data sent) |
| 04 | Snap shot (send current flow rate and alarm status) |
| 06 | Daily average (send the average flow rate since the gage is off) |
| 08 | Pre-day history (send the last 24 hour totals) |
| 10 | Selected history day (send totals from selected day) |
| 12 | Valve on (verify valve is turned on) |
| 14 | Valve off (verify valve is turned off) |

The DDD . . . portion of the response packet can contain the data requested by the central data store 16, such as the flow rate and alarm status for control number 04 or verification that the specified valve is turned on for control number 12. The response packet can be of any format suitable for transmission from the destination well unit 12, through the RF network 20, and to the central data store 16 and is not limited to the format described herein. It is only required that the response packet contain the desired commands and the information necessary to reach the central data store 16.

Following formation <62> of the response packet, the destination well unit transmits <64> the response packet to the next inbound well unit. The response packet travels back through the RF network in the same manner ("well hopping") that the request packet is sent to the destination well unit. In particular, the response packet hops from well unit 12 to well unit 12 via steps <42>, <44>, <66>, and <68>, until it reaches <70> the IP host 14. Next, the IP host 14 sends <72> the response packet to the central data store 16, and before the packet reaches the central data store 16, it is converted from IP format to serial format by a converter device. When the central data store 16 receives <74> the response packet, the data is read and stored.

As the request and response packets are sent from one well unit 12 to the next well unit 12 in the RF network, the sending well unit waits <50> for an acknowledgment that the next well unit has received the packet. The acknowledgment is either receipt of the response packet or the next well unit's repeat. If the acknowledgment is obtained within a programmed retry time, then the sending well unit assumes <52> that the packet has reached its destination. However, if the acknowledgment is not received within a programmed retry time, then the sending well unit compares <54> the number of retries with the total number of retries programmed in the well unit. No action is taken <56> if the number of retries equals the number programmed, but if the number of retries does not equal the number programmed, then the sending well unit again transmits <46> or <66> the request packet to the next well unit.

The well communication system 10 of the current invention has several advantages. The system 10 uses the Internet and RF bands as the main body of communication between wellheads and remote locations. These communication methods are well known, robust, easily accessible, and cost effective. The "well hopping" serial arrangement is inherently efficient, permits facile communication between wellheads clustered together or distant from each other within a well field, and does not require complex equipment in order to transmit information to a remote location. Additionally, the system itself has several quality control functions, such as the CRC and acknowledgment features, to ensure that communication, which includes commands for controlling in addition to monitoring well production, between the wellheads and the remote location is effectual and accurate. Further, all of the equipment at the well site is located at the surface rather than downhole. As a result, installation and repair of the system equipment requires less manpower, heavy machinery, time, and financial resources.

Figure 4:
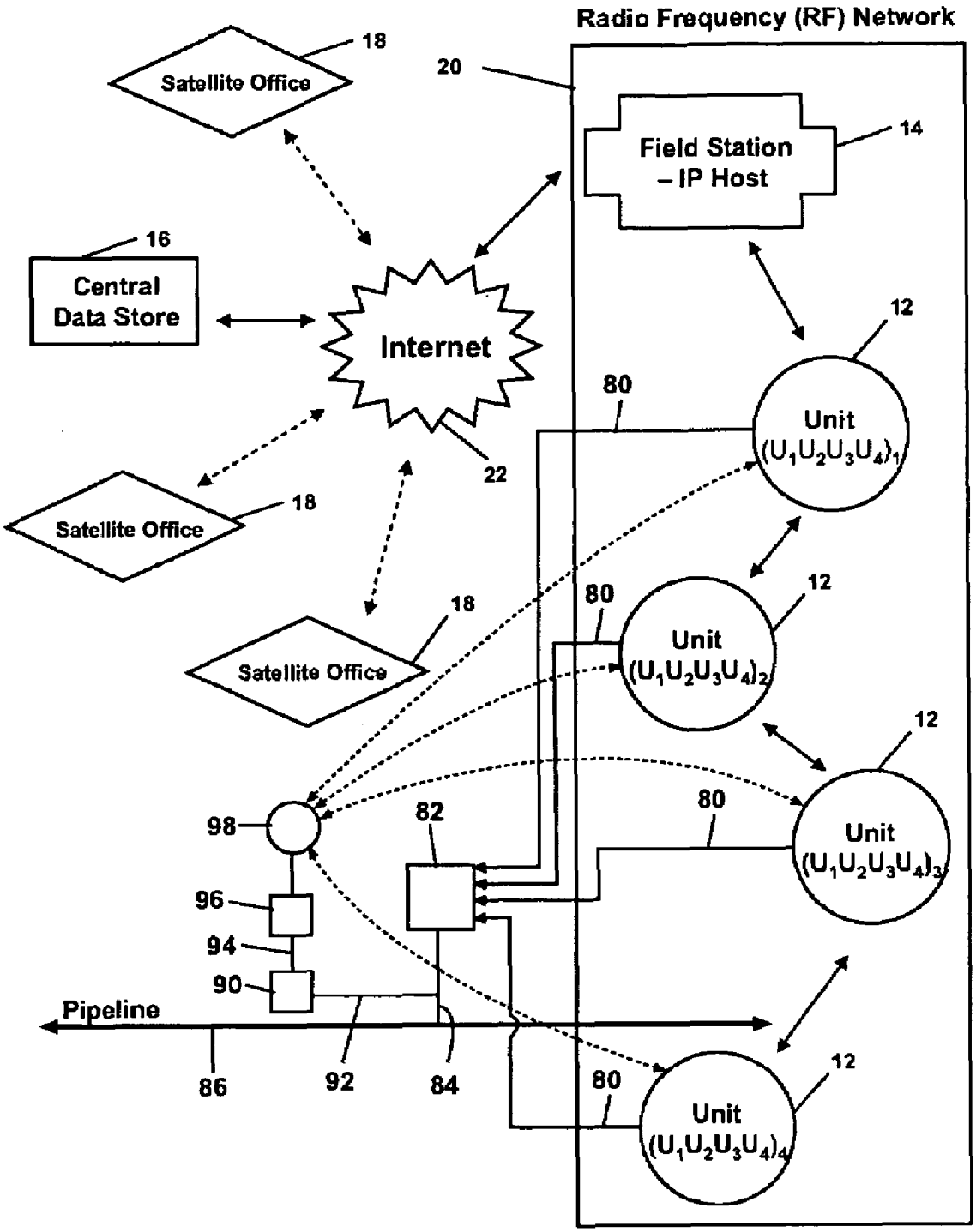
FIG. 4 is a schematic representation of a further embodiment of the invention.

Referring now to FIG. 4 where like numerals are used to designate like elements, each of the wells has a production line 80 which is connected to a central processing station 82. The central processing station 82 pressurizes the gas in the production lines 80 and further can remove hydrogen sulfide from the gas. After pressurization, the processing station then delivers the gas at an elevated pressure to a pipeline 86 through a feed line 84. An oxygen detector 90 samples the gas in the feed line 84 through a sample line 92 and measures the amount of oxygen in the gas. The oxygen detector is a well known oxygen detecting apparatus that measure the oxygen content in a gas line, for example, in parts per million, and generates a voltage representative of the level of oxygen in the gas. A suitable oxygen detector is Model 2010B made by Advanced Micro Instruments Inc. of Garden Grove, Calif. Voltage generated by the oxygen detector is applied to a recorder controller 96 which converts the voltage into a percentage of oxygen. The oxygen detector will sample the gas on a regular basis, for example, every minute or two. The recorder controller will average a number of samples, for example, every ten minutes. The recorder controller 96 is connected to a transmitter 98 which then sends a signal representative of the oxygen level to the central data store through the well hopping system disclosed above with the respect to the embodiments in FIGS. 1-3. To this end, the oxygen signal is coded with different code identifications than the information packet to the well units 12 and flows through the same radio network as well monitoring information. The central data store 16 receives the signals via the internet, the field station -IP host 14 and through the individual well units 12. The average oxygen content in the gas is stored, recorded in digital form every ten minutes and then displayed and printed out as a certification of the amount of oxygen in the gas flowing through a connecting line 84 into the pipeline 86. In the event that the central data store 16 operator is unrelated to any of the well operators, the central data store 16 operator can then certify oxygen content that flows from the central processing station 82 into the commercial pipeline 86.

Figure 5:
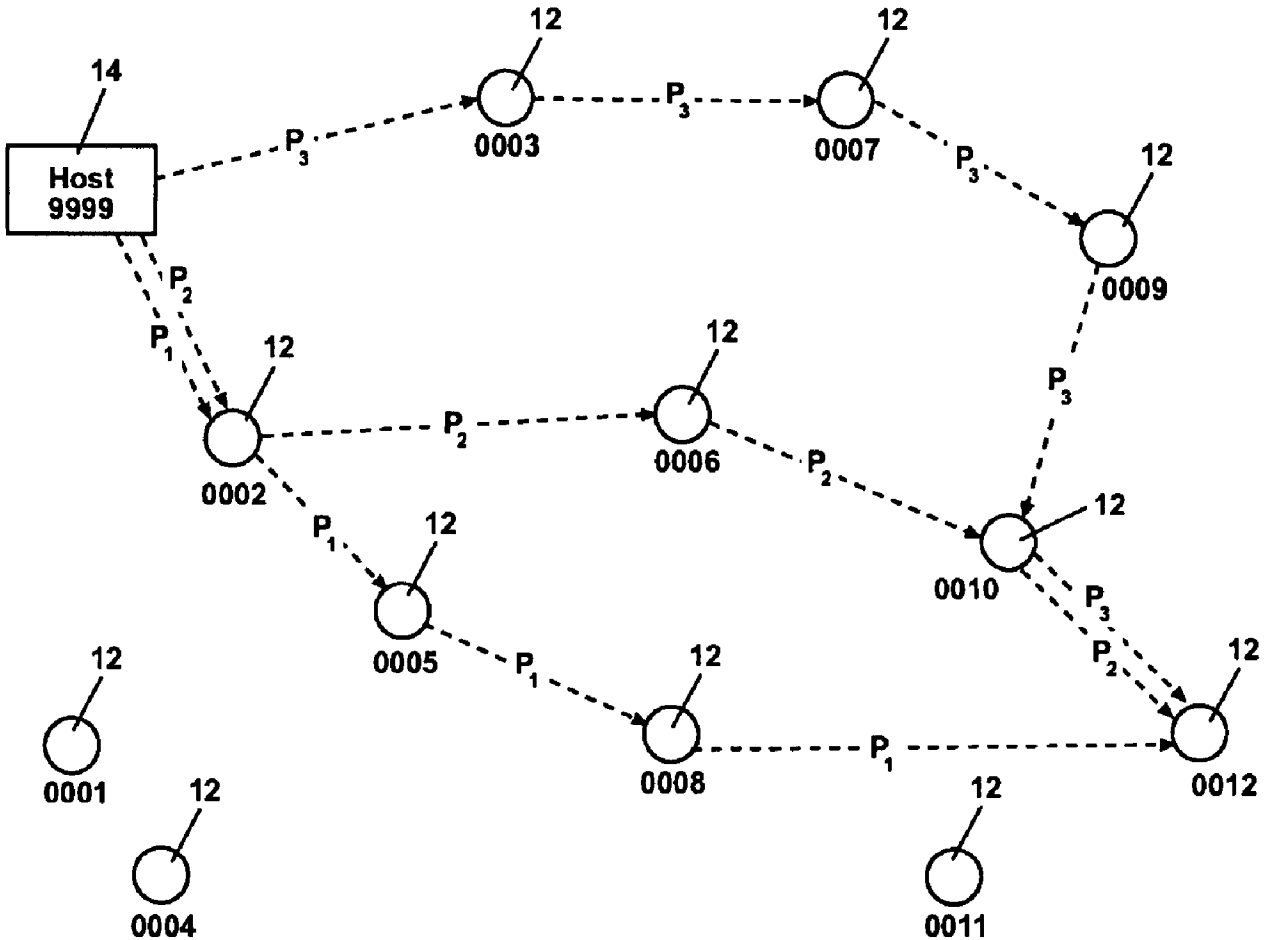
FIG. 5 is a schematic representation of a well field and a station host in which a packet is passed between the station host and a particular well unit in the well field using the systems and methods of FIGS. 1-4.

FIG. 5 shows a schematic diagram of an exemplary well field having the field station 14 (IP host) shown amid several well units 12 dispersed throughout, each well unit 12 having a unique four-digit identifier 0001-0012. It will be understood that greater or fewer well units can be provided in a field without departing from the scope of this invention. The field station 14 is shown with an arbitrary identifier of 9999, although any identifier not already employed by a well unit can be employed without departing from the scope of this invention.

For purposes of this example, it will be understood that an example delivery to and receipt of a packet to the well unit identified by unique identifier 0012 is described, but that any well unit communication is contemplated by this invention.

Three example paths between the field station 14 and the destination well unit 12 (No. 0012) are shown in FIG. 5 and are identified by $P_1$, $P_2$ and $P_3$. Path $P_1$ goes from the field station 9999 to well unit 0002 to well unit 0005 to well unit 0008 and, finally, to well unit 0012. Path $P_2$ goes from the field station 9999 to well unit 0002 to well unit 0006 to well unit 0010 and, finally, to well unit 0012. Path $P_3$ goes from the field station 9999 to well unit 0003 to well unit 0007 to well unit 0009 to well unit 0010 and, finally, to well unit 0012. It will be understood that the paths can be predefined or determined in real-time based on any number of known path algorithms including those based on location, geography, topology, signal strength and other known criteria. It will be understood that the central store can contain a database of these paths which can be fixed and/or updated on a periodic basis in response to changes in field conditions. For this example, it will be understood that the paths are subscripted in order of their priority, such that path $P_1$ is the preferred path for communications with well unit 0012.

Paths are displayed in the packet examples below according to an illustrative convention. For example, path $P_1$ is listed as 9999 0002 0005 0008 0012 with the left-most portion of the path string is the source of the communications (i.e., the field station 14) and the right-most portion of the path string is the destination well unit (in this case, 0012). Intervening well units on the path are listed in between the terminating source and destination points on the path (e.g., 0002, 0005, and 0008 for path $P_1$).

As described above, outbound packets (also referred to as request packets) are identified by an odd-numbered control number CC and inbound packets (also referred to as response packets) are identified by an even-numbered control number CC. It will be understood that, in order to move along a path, a request packet is sent out with an odd-numbered control number which indicates that receiving well units should locate the next well unit in the path by moving to the right in the path string (i.e., to the Next Outbound Unit) and, once a response packet is created by the destination well unit, the response packet (containing an even-numbered control number) is delivered to the source by moving to the right along the path string (i.e., to the Next Inbound Unit).

The delivery of a request packet to a desired well unit will now be described. An initial request packet is formed at the field station 9999 by determining (1) which well unit is to be contacted and, once a destination well unit is identified (0012 in this example), (2) selection of a first selected path along which the communications packet will be sent ($P_1$ in this case).

The first packet is then formed as shown in the table below. It should be noted that the UUUU segment contains the Next Outbound Unit in the path selected by reviewing the path RRR segment. The Next Outbound Unit is selected from the path RRR by first determining whether the control number is odd or even and moving one path segment to the right or left, respectively. Since the packet being sent is a request packet, the control number will be odd, therefore the Next Outbound Unit is selected as 0002 and this address is placed into the UUUU segment of the request packet. Also, the number of hops in path segment RRR is analyzed to determine the total number of hops TT in the path segment. This value has been initialized to 04 in this example (e.g., four hops: 9999-to-0002, 0002-to-0005, 0005-to-0008 and 0008-to-0012). The number of completed hops segment MM is initialized to 01 (since this is the first hop). Then, the packet is transmitted.

| REQUEST PACKET | SAMPLE PACKET DATA |
|---|---|
| SS | XX |
| CC | XX (odd for request packet) |
| UUUU | 0002 |
| CCCC | XXXX |
| TT | 04 |
| MM | 01 |
| RRR... | 9999 0002 0005 0008 0012 |
| DDD... | Send Data |
| XXXX | XXXX (cycle redundancy check) |

Since the UUUU segment contains unique ID 0002, this packet will be received by well unit 0002. The test for "end of path" is performed on the path segment RRR. This "end of path" test can be performed in a multitude of ways, some examples of which are described here.

First, the selected path direction based on the control code segment CC can be tested based on the path segment RRR—that is, if the selected path direction is right (i.e., an Outbound or request packet), the UUUU segment can be located within the path segment RRR and determined whether a Next Outbound Unit address exists in the path (or whether the end of the path segment string has been reached). If the end of the string has been reached, the current unit must be the destination unit for the packet). If this test is used, it will be understood that the total hops TT and current hops MM segments of the packet are not necessary and can be removed.

Second, another example "end of path" test is the number of hops test described above. The number of hops segment TT is initialized at the field station by analysis of the path segment RRR and determining the number of unique hops needed to complete the path segment RRR and the number of current hops segment MM is initialized to 01 to set the packet initially at a single current hop. Each "hop" along the segments of the path cause the current hops segment MM to be incremented. When the number of current hops MM equals the total number of hops TT, the trip is complete since the path was followed to its completion.

Finally, another "end of path" test could be performed by simply including the unique ID of the final destination as a segment of the request packet and the unique ID of the destination well unit can be compared with the ID of the receiving well unit. If they are the same, the packet is at the destination unit.

For this example, the number of hops end of path test will be described. Once the above packet is received at well unit 0002, the following steps are performed. First, the ID segment UUUU is analyzed and compared to the receiving unit's ID. Since both are 0002, processing continues (otherwise this packet would be ignored by another other well unit not having ID 0002 that detects the packet). Next, the number of hops MM (01) is compared to the total number of hops (04). Since they are not equal, the request packet is not at the end of the line. Therefore, since the control code segment CC is odd, the well unit (0002) retrieves the path segment, locates the 0002 ID in the path, determines the Next Outbound Unit (0005 in this case) and inserts the ID of the Next Outbound Unit into the destination segment UUUU in the request packet. The well unit 0002 also increments the current hops MM segment as well so that the request packet sent on to the Next Outbound Unit 0005 appears as follows:

| REQUEST PACKET | SAMPLE PACKET DATA |
|---|---|
| SS | XX |
| CC | XX (odd for request packet) |
| UUUU | 0005 |
| CCCC | XXXX |
| TT | 04 |
| MM | 02 |
| RRR... | 9999 0002 0005 0008 0012 |
| DDD... | Send Data |
| XXXX | XXXX (cycle redundancy check) |

Since well unit 0005 is also not the end destination, the same steps are performed on the request packet by well unit 0005:

| REQUEST PACKET | SAMPLE PACKET DATA |
|---|---|
| SS | XX |
| CC | XX (odd for request packet) |
| UUUU | 0008 |
| CCCC | XXXX |
| TT | 04 |
| MM | 03 |
| RRR... | 9999 0002 0005 0008 0012 |
| DDD... | Send Data |
| XXXX | XXXX (cycle redundancy check) |

Well unit 0008 (i.e., the latest identified Next Outbound Unit), also performs the same steps as well:

| REQUEST PACKET | SAMPLE PACKET DATA |
|---|---|
| SS | XX |
| CC | XX (odd for request packet) |
| UUUU | 0012 |
| CCCC | XXXX |
| TT | 04 |

-continued

| REQUEST PACKET | SAMPLE PACKET DATA |
|---|---|
| MM | 04 |
| RRR... | 9999 0002 0005 0008 0012 |
| DDD... | Send Data |
| XXXX | XXXX (cycle redundancy check) |

Now, when this packet is received by well unit 0012, the "end of path" test is performed. In this case using the number of hops test, the current number of hops MM (04) equals the total number of hops TT (04), signifying that the trip to the destination unit is complete. Well unit 0012 then performs the command identified by control code CC and any associated data DDD.

A response packet is then prepared by well unit 0012 which has the current number of hops reset to 01 and the Next Inbound Unit identified in the UUUU segment:

| RESPONSE PACKET | SAMPLE PACKET DATA |
|---|---|
| SS | XX |
| CC | XX (even for response packet) |
| UUUU | 0008 |
| CCCC | XXXX |
| TT | 04 |
| MM | 01 |
| RRR... | 9999 0002 0005 0008 0012 |
| DDD... | Return Data |
| XXXX | XXXX (cycle redundancy check) |

The response packet is sent to the Next Inbound Unit (i.e., 0008) which performs the same retransmission steps on the response packet as it did on the request packet—resulting in a retransmitted response packet to the Next Inbound Unit (0005) in the form of:

| RESPONSE PACKET | SAMPLE PACKET DATA |
|---|---|
| SS | XX |
| CC | XX (even for response packet) |
| UUUU | 0005 |
| CCCC | XXXX |
| TT | 04 |
| MM | 02 |
| RRR... | 9999 0002 0005 0008 0012 |
| DDD... | Return Data |
| XXXX | XXXX (cycle redundancy check) |

Well unit 0005, again not the destination unit, retransmits the response packet as:

| RESPONSE PACKET | SAMPLE PACKET DATA |
|---|---|
| SS | XX |
| CC | XX (even for response packet) |
| UUUU | 0002 |
| CCCC | XXXX |
| TT | 04 |
| MM | 03 |
| RRR... | 9999 0002 0005 0008 0012 |
| DDD... | Return Data |
| XXXX | XXXX (cycle redundancy check) |

Well unit 0002, again not the destination unit, retransmits the response packet as:

| RESPONSE PACKET | SAMPLE PACKET DATA |
|---|---|
| SS | XX |
| CC | XX (even for response packet) |
| UUUU | 9999 |
| CCCC | XXXX |
| TT | 04 |
| MM | 04 |
| RRR... | 9999 0002 0005 0008 0012 |
| DDD... | Return Data |
| XXXX | XXXX (cycle redundancy check) |

Since the "end of path" test now passes, the receiving unit (the field station 14 identified by ID 9999 in this example) knows that it is the final destination of the response packet and processes the data contained in the packet accordingly.

While the preferred embodiment of the well communication system 10 has been described herein with relation to gas, oil, and other wells, it is within the scope of this invention to use the communication system with any type of data gathering, monitoring, or automatic control system, especially for those that involve transfer of information to or from a remote location. The "well hopping" arrangement is not limited to use with wells and can be applied in numerous other communication systems.

Reasonable variation and modification are possible within the forgoing description and drawings without departing from the spirit of the invention. While the invention has been specifically described in connection with certain specific embodiments thereof, it is to be understood that this is by way of illustration and not of limitation, and the scope of the appended claims should be construed as broadly as the prior art will permit.

The invention claimed is:

1. A system for collecting and storing well data at from geographically spaced wells comprising:

a central store adapted to receive and store data from a distant source and further comprises a computer processor that is programmed to encode data packets to and from the well monitors with an address unique to each of the well monitors and with a predefined communication path;

a plurality of well monitors, each of which is adapted to be associated with a gas or oil well and each of which is programmed to record oil or gas well production data at a given oil or gas well location, each of the well monitors further having a transceiver for transmitting a wireless signal representative of the recorded oil or gas production data of the respective well with which it is associated, the well monitors are further programmed to receive wireless signals representative of data from other of said well monitors and transmit the received data to other of said well monitors and to a data transmission processor and each of the well monitors is programmed to pass on to another well monitor data packets that it receives and that have an address different than the address of the respective well monitor;

the data transmission processor is adapted to be placed in a field location geographically spaced from the oil or gas wells that have at least one of said well monitors associated therewith, the data transmission processor has a receiver that is adapted to receive wireless data signals transmitted from at least one of the well monitors, has a converter to convert the received wireless data from the at least one well monitor to a communication signal and has a transmission connection to send the converted communication signal from the field location to the central data store;

whereby oil or gas well production data can be transmitted to the central data store by hopping from well monitor to well monitor along the predefined path to the data transmission processor which can then, in turn, transmit the oil or gas well production data to the central store for storage and analysis.

2. The system of claim 1 wherein each of the well monitors is programmed to transmit data over radio waves in a 900 MHz frequency band.

3. The system of claim 1 wherein each of the well monitors has an integrated communications and control unit that comprises a radio module and a central processing unit that run solely on transistor-transistor logic (TTL) level voltages.

4. The system of claim 1 and further comprising a recorder controller adapted to convert a voltage representative of the oxygen content in a gas line into a signal representative of the oxygen content in the gas line, a transmitter connected to the recorder controller for transmitting the signal representative of the oxygen content of the gas line to the central data store through a wireless signal that hops along the predefined path that includes at least two of the well monitors and the data collection and transmission processor.

5. The system of claim 1 wherein the data store has a computer processor that is programmed to retrieve data from one or more well monitors upon request from the one or more remote users under certain conditions.

6. The system of claim 1 wherein the central data store has a computer processor that is programmed to make selective data available to one or more remote users under predetermined conditions.

7. The system of claim 6 wherein the data store computer processor is further programmed to retrieve data from one or more well monitors upon request.

8. The system of claim 6 wherein the data store computer processor is programmed to retrieve data from one or more well monitors upon request from the one or more remote users under certain conditions.

9. A method for communicating between geographically spaced wells and a central data store at a remote location with respect to the geographically spaced wells, comprising:

encoding a data request packet with an address unique to a destination well monitor at a destination well and with a predefined path that includes a well monitor at each of at least two geographically spaced wells;

sending the encoded data request packet from the central data store to a field station;

transferring the encoded data request packet from the field station to a first well monitor at a first well in the predefined path via radio waves;

determining if the first well monitor is the destination well monitor; and if the first well monitor is not the destination well monitor, hopping the request data packet along the predefined path via radio waves until the request data packet reaches the destination well monitor.

10. The method of claim 9 wherein the act of sending the data request packet from the central data store to the field station is via the Internet.

11. The method of claim 9 wherein there are a plurality of geographically spaced wells, each with a monitor that has a unique address and the data request packet is sent from the central data store to the field station and to each of the monitors.

12. The method of claim 11 and further comprising transmitting a request from a remote user to the central data store for a data packet from the destination well monitor; and the act of sending the data request packet from a central data store to a field station is responsive to the request from the remote user.

13. The method of claim 9 and further comprising sending a response data packet from the destination well monitor to the field station along the predefined path but in the opposite direction.

14. The method of claim 13 wherein the response data packet is sent from the destination well monitor to the field station by hopping the response packet via radio waves from the destination well monitor along the predefined path until the destination packet reaches the field station.

15. The method of claim 14 and further comprising the step of sending the response data packet from the field station to the central data store.

16. The method of claim 15 wherein the step of sending the response data packet from the field station to the central data store is via the Internet.

17. A system for collecting and storing well data from a plurality of geographically spaced oil or gas wells comprising:

a central data store positioned at a remote location from the plurality of geographically spaced wells and adapted to receive and store data from a distant source through a predefined communication path, the central store further has a computer processor that is programmed to encode data packets to and from the well monitors with an address unique to each of the well monitors and with a predefined path;

each of the plurality of geographically spaced wells has associated therewith a well monitor, each of the well monitors is programmed to record oil or gas well production data at its associated oil or gas well location, each of the well monitors further has a transceiver for transmitting a wireless signal representative of the recorded oil or gas production data of the respective well that it is associated with, the well monitors are further programmed to receive wireless data packets from other of said well monitors and, if it is in the predefined path, transmit to other of said well monitors and to a data transmission processor the received data packets that have a destination address different than the address of the respective well monitor;

the data transmission processor is positioned in a field location geographically remote from the central data store and in the geographic region containing the plurality of geographically spaced wells within range to receive a wireless signal from at least one of the plurality of geographically spaced wells that have one of said well monitors associated therewith, the data transmission processor has a receiver that is adapted to receive wireless data signals transmitted from the at least one of the well monitors, has a converter to convert the received wireless data from the at least one well monitor to a communication signal and has a transmission connection to send the converted communication signal from the field location to the central data store;

whereby oil or gas well production data can be transmitted to the central data store by hopping from well monitor to well monitor along a predefined path to the data collection and transmission processor which can then, in turn, transmit the oil or gas well production data to the central store for storage and analysis.

18. The system of claim 17 wherein each of the well monitors is programmed to transmit data over radio waves in a 900 MHz frequency band.

19. The system of claim 17 wherein each of the well monitors has an integrated communications and control unit that comprises a radio module and a central processing unit that run solely on transistor-transistor logic (TTL) level voltages.

20. The system of claim 17 and further comprising a recorder controller adapted to convert a voltage representative of the oxygen content in a gas transmission line into a signal representative of the oxygen content in the gas transmission line, a transmitter connected to the recorder controller for transmitting the signal representative of the oxygen content of the gas in the gas transmission line to the central data store through a wireless signal that hops along the predefined path that includes at least two of the well monitors and the data collection and transmission processor.

21. The system of claim 17 wherein the central data store has a computer processor that is programmed to retrieve data from one or more well monitors upon request from the one or more remote users under certain conditions.

22. The system of claim 17 wherein the central data store has a computer processor that is programmed to make selective data available to one or more remote users under predetermined conditions.

23. The system of claim 22 wherein the data store computer processor is further programmed to retrieve data from one or more well monitors upon request.

24. The system of claim 22 wherein the data store computer processor is programmed to retrieve data from one or more well monitors upon request from the one or more remote users under certain predetermined conditions.

* * * * *